United States Patent [19]

Lu

[11] 4,445,245

[45] May 1, 1984

[54] SURFACE SWEEPER

[76] Inventor: Ning K. Lu, 31-29 Crescent St., Long Island City, N.Y. 11106

[21] Appl. No.: 410,530

[22] Filed: Aug. 23, 1982

[51] Int. Cl.[3] ..... A47L 5/26

[52] U.S. Cl. ..... 15/23; 15/43; 15/344; 15/383

[58] Field of Search ..... 15/344, 43, 23, 388, 15/383

[56] References Cited

U.S. PATENT DOCUMENTS

| | | | |
|---|---|---|---|
| 2,476,537 | 7/1949 | Erickson | 15/383 |
| 2,537,523 | 1/1951 | Frost | 15/383 X |
| 2,578,549 | 12/1951 | Hooban | 15/43 X |
| 2,994,098 | 8/1961 | Fukuba | 15/43 X |
| 3,308,498 | 3/1967 | Evans | 15/344 X |
| 3,872,539 | 3/1975 | Doyel | 15/344 |

*Primary Examiner*—Chris K. Moore

*Attorney, Agent, or Firm*—Charles E. Temko

[57] ABSTRACT

A miniature electrically powered surface sweeper having a rotary brush element which is adapted to come in direct contact with a surface to be cleaned. The brush element is disposed within a housing having a curved inner wall surface which contacts the bristles as the same move inwardly within the housing to prevent loss of dust particles. A receptacle element is provided with a movable trap opened by the moving of an electrical switch to closed position to power the brush element, and closed when the switch is opened to discontinue operation of the brush element. The brush element includes bristles which are formed of cutting a planar sheet of synthetic resinous material to form flat bristles attached to a base, the base being in turn attached to an outer surface of a rotating drum member to permit convenient replacement.

2 Claims, 5 Drawing Figures

SURFACE SWEEPER

BACKGROUND OF THE INVENTION

This invention relates generally to the field of miniaturized surface sweepers having a powered rotary drum element, and more particularly to an improved form thereof particularly suited for claning drafting tables and drawings disposed thereon, worktables, dining table surfaces and the like. Devices of this general type are well known in the art, and the invention lies in specific constructional details which permit improved operation, convenience in use, and lowered cost of manufacture.

At the present state of the art, draftsmen and artists normally clean the surface of their tables and their work using a drafting or dust brush to sweep dust away. The use of such a brush does not collect dust but serves only to scatter the same away from the work area, so that ultimately a separate cleaning operation is required. It is known in the art to provide relatively small sized cleaners which are battery powered and handheld during operation. Such cleaners have suffered from a variety of disadvantages, including relatively low efficiency, high current consumption, excessive bulk and complicated construction.

SUMMARY OF THE INVENTION

Briefly stated, the invention contemplates the provision of an improved miniature surface sweeper which is effective and convenient for a plethora of cleaning operations that are too small to warrant use of a full size vacuum cleaner, and too messy to be cleaned by hand. The sweeper comprises a housing, one side wall of which has a curved inner surface which cooperates with a revolving brush element to guide the dust into a receptacle. The receptacle is provided with a closable trap which is opened when a power switch is moved to a position making the brush element operative, the trap closing when current is disconnected to the bush element driving means. The dust receptacle is in the form of a removable drawer which may be pulled from the housing to be emptied and subsequently replaced. The brush element includes a rotating cylinder, the outer surface of which is provided with bristles formed by cutting a sheet of synthetic resinous material to comb-like configuration, and adhering the base in spiral fashion to the outer surface of the cylinder. The ends of the "bristles" are allowed to contact the curved wall surface to prevent loss of dust particles, and with wear the comb-like members can be conveniently replaced with only minimal disassembly of the device.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
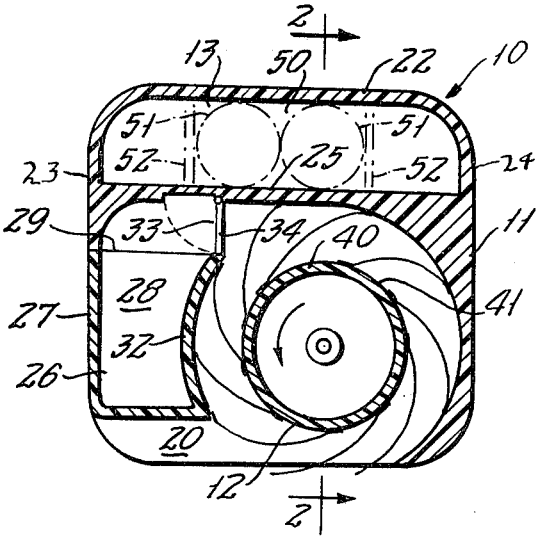
FIG. 1 is a cross sectional view of an embodiment of the invention as seen from the plane 1—1 in FIG. 2.
Figure 2:
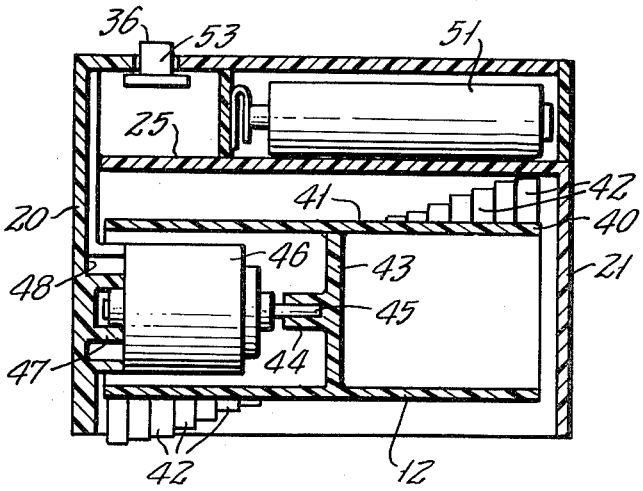
FIG. 2 is a cross sectional view thereof, as seen from the plane 2—2 in FIG. 1.
Figure 3:
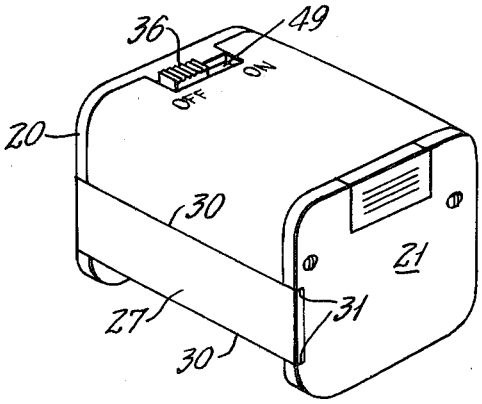
FIG. 3 is a perspective view thereof.

In accordance with the invention, the device, generally indicated by reference character 10, comprises broadly: a housing element 11, a brush element 12, and a self-contained power source 13.

Figure 4:
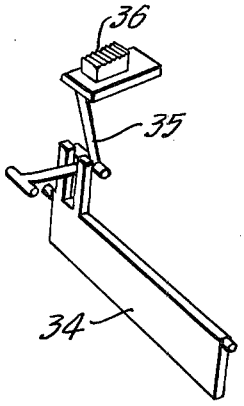
FIG. 4 is a perspective view showing the coupling of a power switch with a dust trap member for simultaneous movement.

The housing element 11 includes first and second side walls 20 and 21, respectively, an upper wall 22, a forward wall 23, and a rear wall 24. A horiztonal septum 25 extends between the side walls, and forms a compartment for the power source 13. A removable box-like dust receptacle 26 is slidably associated with the remaining parts of the housing element. It includes an outer wall 27, a pair of side walls, one of which is indicated by reference character 28, and provides an upper opening 29 for the reception of dust and particulate matter. The outer ends 30 of the outer wall 27 are engageable within corresponding notches 31 in the side walls 20–21 to provide a convenient means for removal. A lower wall 32 is disposed above an intake opening 33 adjacent the brush element. A pivotally mounted trap 34 is suspended from the septum 25 and includes linkage means 35 (see FIG. 4) to enable the same to cooperate with movement of a sliding member 36 of a manually operated power switch.

Figure 5:
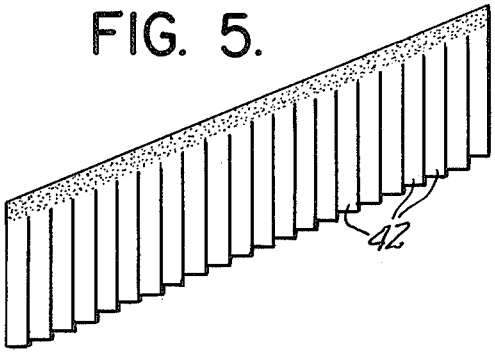
FIG. 5 is a view in elevation of a bristle element forming a part of the embodiment.

The brush element 12 includes a hollow cylinder 40, an outer surface 41 of which supports synthetic resinous flat bristles 42 (see FIG. 5). A central septum 43 mounts a laterally extending bushing 44 which engages the shaft 45 of a small electric motor 46 suitable for operation in the three to six volt range. The motor is carried by a circular extension 47 on the inner surface 48 of the side wall 20, and is interconnected by conductors (not shown) with the power source 13.

The power source 13 is disposed within a recess 50 in the housing element 11, and is adapted to accommodate between two and four small dry cells 51 which are held in position by vertical septums 52. A sliding switch 53 includes the extension 36 which projects outwardly of the housing element in a slot 49 for movement between on an off positions, this movement serving to also open and close the trap 34 to prevent loss of collected material.

As contrasted with many prior art sweepers, it is contemplated that the tips of the individual bristles contact the curvilinear interior surface of the housing element, both for the purpose of preventing loss of dust particles, and for imparting a static charge to the bristles which will assist in the sweeping action. As the bristles are of relatively lightweight material, the frictional resistance involved is slight, and as wear shortens the effective length of the brisltes, they may be conveniently replaced by removing the cylinder 40, and peeling off the comb-like members to be replaced by similar new members, using a pressure sensitive adhesive (not shown) or the like.

It may thus be seen that I have invented a novel and highly useful miniature surface sweeper which possesses many advantages not known in the prior art. By the use of comb-like bristles made from thin synthetic resinous material, high flexibility of the bristles is obtained permitting actual contact with a corresponding curvilinear wall to enhance suction, and permit the ends of the bristles to project outwardly from the intake opening to positively engage particles being collected, rather than relying on suction alone. Because of the cube-like configuration, the item is easily grasped and moved over the surfaces to be cleaned, and no external handle is necessary. The presence of a manually openable trap leading to a dust receptacle, which is controlled by movement of the power switch prevents accidental loss of any collected particles, should the device be accidentally overturned when not in use.

I wish it to be understood that I do not consider the invention limited to the precise details of structure shown and set forth in this specification, for obvious modifications will occur to those skilled in the art to which the invention pertains.

I claim:

1. A miniature surface sweeper comprising: a housing element having a wall defining a curvilinear inner surface; a dust receptacle disposed at a part of said housing element opposite said wall, said receptacle being removable for emptying; a rotary brush element including a cylindrical surface disposed between said wall and said dust receptacle, and having flexible bristles thereon in the form of a comblike member, the base of which is secured to said cyclindrical surface, said housing element having an intake opening through which the tips of bristles may project to directly engage collected particles; and means for driving said brush element to rotate the same in the direction delivering collected particles along said curvilinear surface to said dust receptacle; said driving means including an electric motor and a power source therefor; said dust receptacle having a closable trap, said power source including a manually movable electric switch coupled to said trap for simultaneous movement, wherein moving said switch to closed position serves to open said trap.

2. A sweeper in accordance with claim 1, further characterized in a provision of bristle elements which are cut to flat comb-like configuration, wherein the bristles thereof are in staggered relation, and in which the base thereof is secured to said cylinder in a spiral fashion.

* * * * *